US006688994B2

(12) United States Patent
Matulek et al.

(10) Patent No.: US 6,688,994 B2
(45) Date of Patent: Feb. 10, 2004

(54) BATTING AID

(76) Inventors: Andrew M. Matulek, 31 Vienna Woods, Beaufort, MO (US) 63013; Ronald C. Thorpe, 261 Ridgeway Dr., Union, MO (US) 63094

( * ) Notice: Subject to any disclaimer, the term of this patent is extended or adjusted under 35 U.S.C. 154(b) by 20 days.

(21) Appl. No.: 10/192,587

(22) Filed: Jul. 11, 2002

(65) Prior Publication Data

US 2004/0009832 A1 Jan. 15, 2004

(51) Int. Cl.[7] ..... A63B 69/00; A63B 63/00

(52) U.S. Cl. ..... 473/429; 473/430; 473/422; 273/331

(58) Field of Search ..... 473/422–432, 473/415–419, 138–149; 273/331–335

(56) References Cited

U.S. PATENT DOCUMENTS

| | | | | | |
|---|---|---|---|---|---|
| 2,305,187 | A | | 12/1942 | Neiden | |
| 2,652,250 | A | | 9/1953 | Alder et al. | |
| 2,976,040 | A | | 3/1961 | Bales | |
| 3,006,647 | A | | 10/1961 | Haskett | |
| 3,397,885 | A | | 8/1968 | Nash, Jr. | |
| 3,547,437 | A | * | 12/1970 | Andersen | 473/427 |
| 3,948,517 | A | * | 4/1976 | Feiler | 473/429 |
| 4,050,694 | A | | 9/1977 | Domroski | |
| 4,502,684 | A | * | 3/1985 | Rocha | 473/429 |
| 4,647,042 | A | | 3/1987 | Bruce | |
| 5,374,056 | A | | 12/1994 | Scher et al. | |
| 5,467,978 | A | * | 11/1995 | Paluch | 473/430 |
| 5,531,438 | A | * | 7/1996 | Corley | 473/429 |
| 5,683,315 | A | | 11/1997 | Ring | |
| 5,924,930 | A | * | 7/1999 | Stewart | 473/429 |
| 6,290,618 | B1 | | 9/2001 | Ring | |

FOREIGN PATENT DOCUMENTS

| | | |
|---|---|---|
| CA | 1323385 | 10/1993 |
| CA | 2129912 | 1/1996 |

* cited by examiner

*Primary Examiner*—Paul T. Sewell
*Assistant Examiner*—Mitra Aryanpour
(74) *Attorney, Agent, or Firm*—Richard C. Litman

(57) ABSTRACT

A batting aid that may easily be installed upon fixed or temporary structures, made up of a main frame that slidably supports a tube which in turn supports a ball for a batter to hit. The ball is fixed to the tube by a wire cable that extends through the ball, and is in turn mounted to the tube. The tube is height adjustable so that batters of differing stature and ages can easily practice upon balls at varied heights. The assembly is strong in construction so that a practicing batter is able to hit the ball hard and not cause damage or require another player to throw balls over the plate or return balls to the batter.

7 Claims, 5 Drawing Sheets

BATTING AID

BACKGROUND OF THE INVENTION

1. Field of the Invention

The present invention relates to baseball batter aids, and more particularly to an assembly to present a ball to be swung at and hit by a batter who wishes to practice the technique of hitting a ball such as a baseball, softball or tennis ball. The device is also very well adapted to warm-up batters prior to a game or their turn at bat.

2. Description of the Related Art

There is a need for a batting training and warm-up device or structure that is uncomplicated in structure yet adjustable in height and length, with a ball wire-tethered to the device. The related art of interest is as follows.

Canadian Patent No. 1,323,385 to McGuckin et al. for a "Reflex Skill Practice Device and Method" requires another user to present the ball to a batter.

U.S. Pat. No. 2,976,040 to Bales for a "Practice Tether Ball Device", U.S. Pat. No. 5,683,315 to Ring for a "Portable Tethered Ball Batting Practice Apparatus", and U.S. Pat. No. 6,290,618 to Ring for a "Portable Ball Batting Practice Apparatus" are all difficult to adjust in height.

U.S. Pat. No. 2,652,250 to Alder et al. for a "Baseball Batting Tee" and U.S. Pat. No. 3,397,885 to Nash, Jr. for a "Supporting Structure and Ball Releasably Suspended Therefrom" allow a ball to be separated and require fielding assistance.

U.S. Pat. No. 2,305,187 to Neiden for a "Sport Practice Apparatus" discloses a ball presentation assembly that appears to make it difficult to change the height of the ball.

U.S. Pat. No. 3,006,647 to Haskett for "Batting Practice Devices", U.S. Pat. No. 4,050,694 to Domroski for a "Batting Practice Kit", U.S. Pat. No. 4,647,042 to Bruce for a "Sports Training Apparatus", U.S. Pat. No. 5,246,226 to McGuinn and U.S. Pat. No. 5,374,056 and Canadian Patent No. 2,129,912 to Scher et al. for a "Baseball Practice Device" are all free standing and lack attachment to any structure.

None of the above inventions and patents, taken either singularly or in combination, is seen to describe the instant invention as claimed. Thus a batting aid solving the aforementioned problems is desired.

SUMMARY OF THE INVENTION

The invention is a batting aid that may easily be installed upon fixed or temporary structures. It has a main frame that slidably supports a tube which in turn supports a ball for a batter to hit. The ball is fixed to the tube by use of a wire cable that extends through the ball and is in turn mounted to the tube. With the tube being easily adjusted, batters of differing stature and ages can easily practice upon balls at varied heights. With the assembly being rather robust, a practicing batter is able to hit the ball hard and not cause damage to the structure. The invention may be used alone; it does not require another player to throw balls over the plate or return balls to the batter.

Accordingly, it is a principal object of the invention to provide a mechanism for batters to warm up in preparation of playing baseball or softball.

It is another object of the invention to provide a mechanism to teach young batters the mechanics of batting.

It is a further object of the invention to provide users the feel of hitting a ball without needing a pitcher or fielders.

Still another object of the invention is to provide a batting practice assembly that may be installed almost anywhere.

It is a further object of the invention to provide a highly flexible device that may permit use at a wide variety of heights to allow players of all sizes and ages to practice or learn.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a well supported but flexible batting aid that can be used for instruction of batters or for warm-up for a team. It is easily adjusted for height to permit use by any size or age player. It is robust and reliable and will continue to function for an extended period of time. It does not need additional players for throwing the ball over-the-plate or for return of the balls to the batter.

Figure 5:
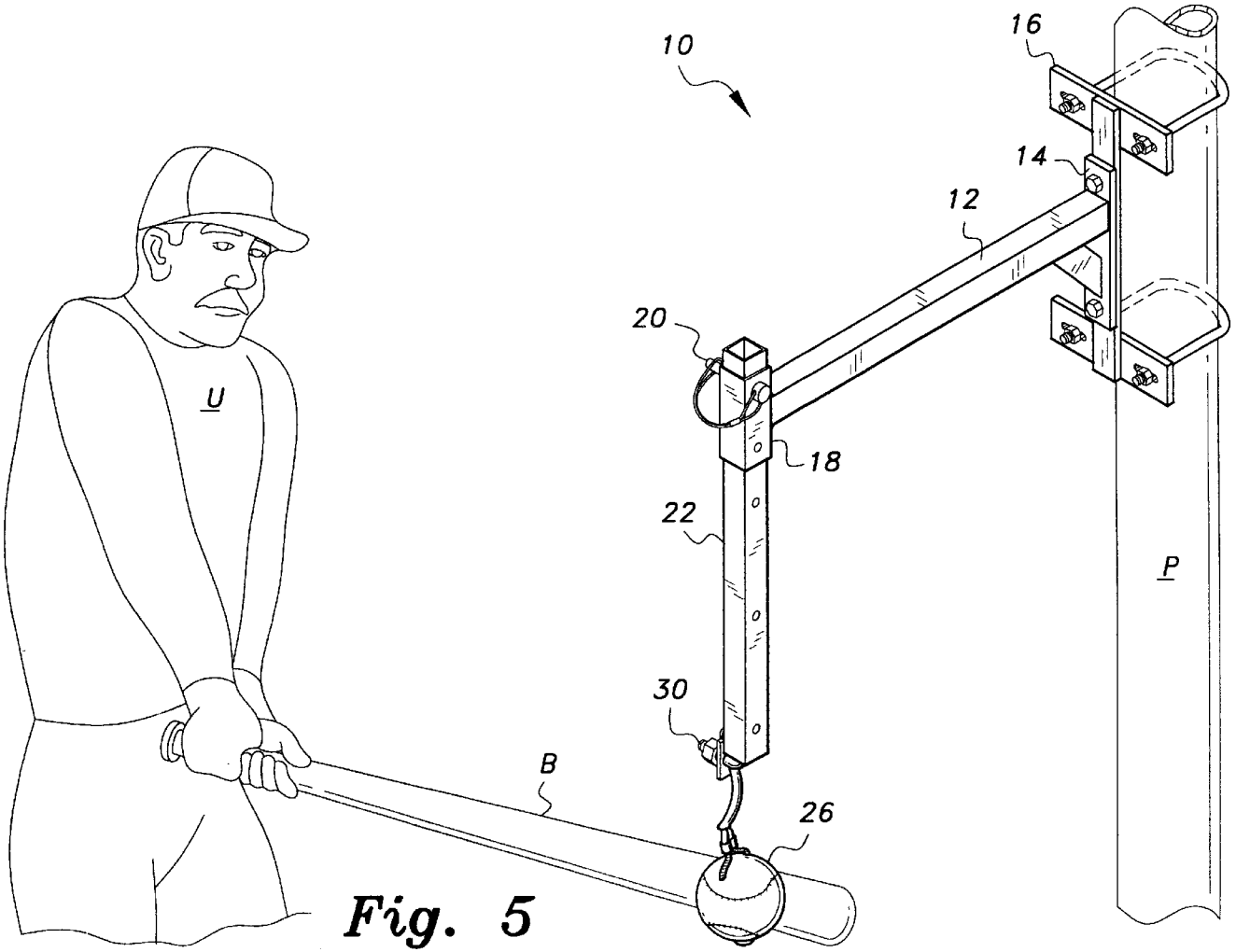
FIG. 5 is an environmental perspective view of a user at practice with the ball at a lower or medium setting.
Figure 6:
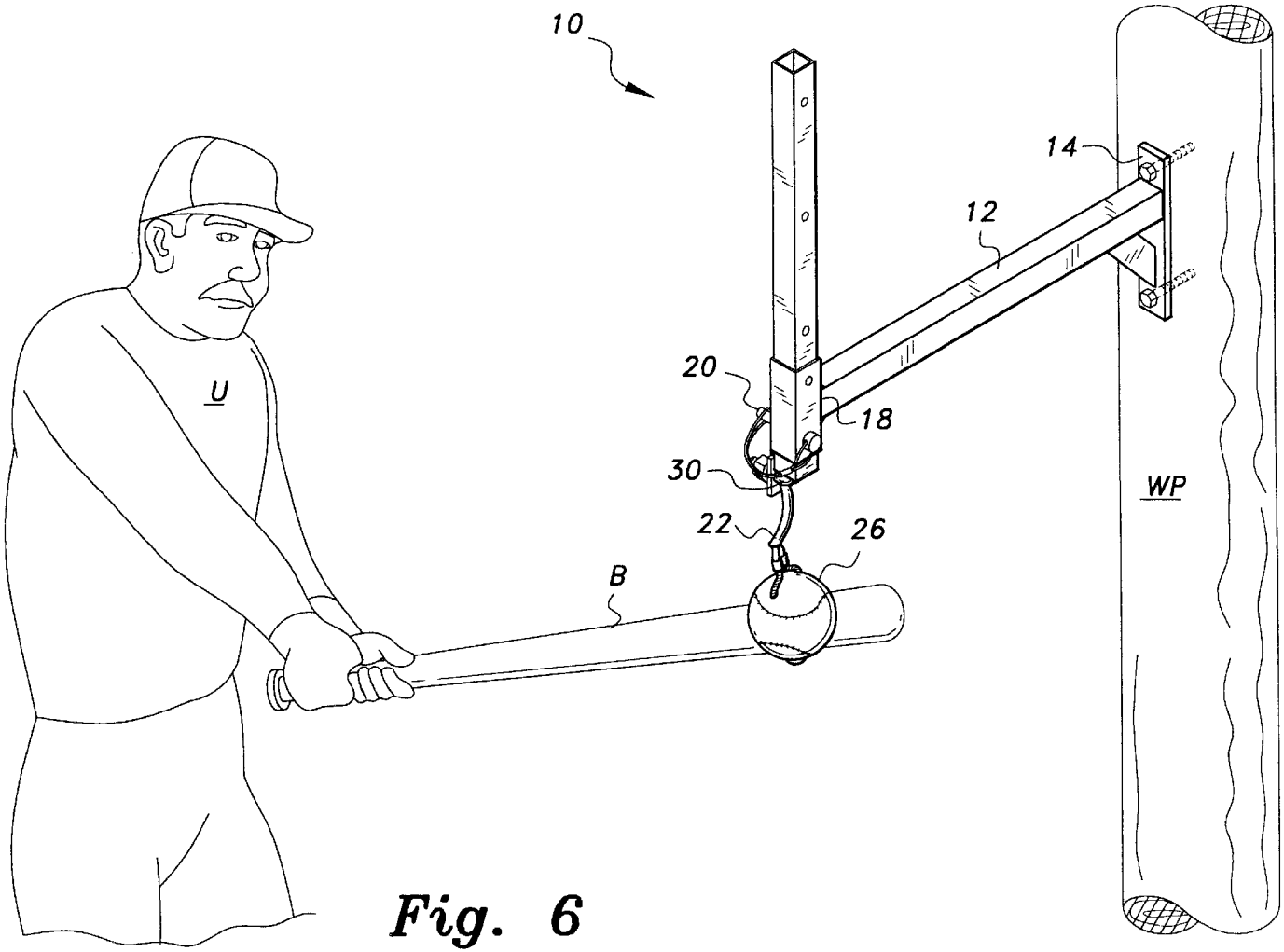
FIG. 6 is an environmental view of the batting aid being used at a higher setting after adjustment from the mounting of FIG. 5.

The batting aid 10 has a main frame 12. Though shown as a square tube, the main frame could also be of other cross-sectional shape (e.g., circular, hexagonal, etc.). On one end it has a standard mount 14 which is usually attached to a universal mount 16, usually by bolts. U-bolts are shown in FIG. 5, for attaching the device to a post P. Or, one may anchor the main frame 10, by using screws, to attach directly to a wooden post or structure WP, as best seen in FIG. 6.

Figure 1:
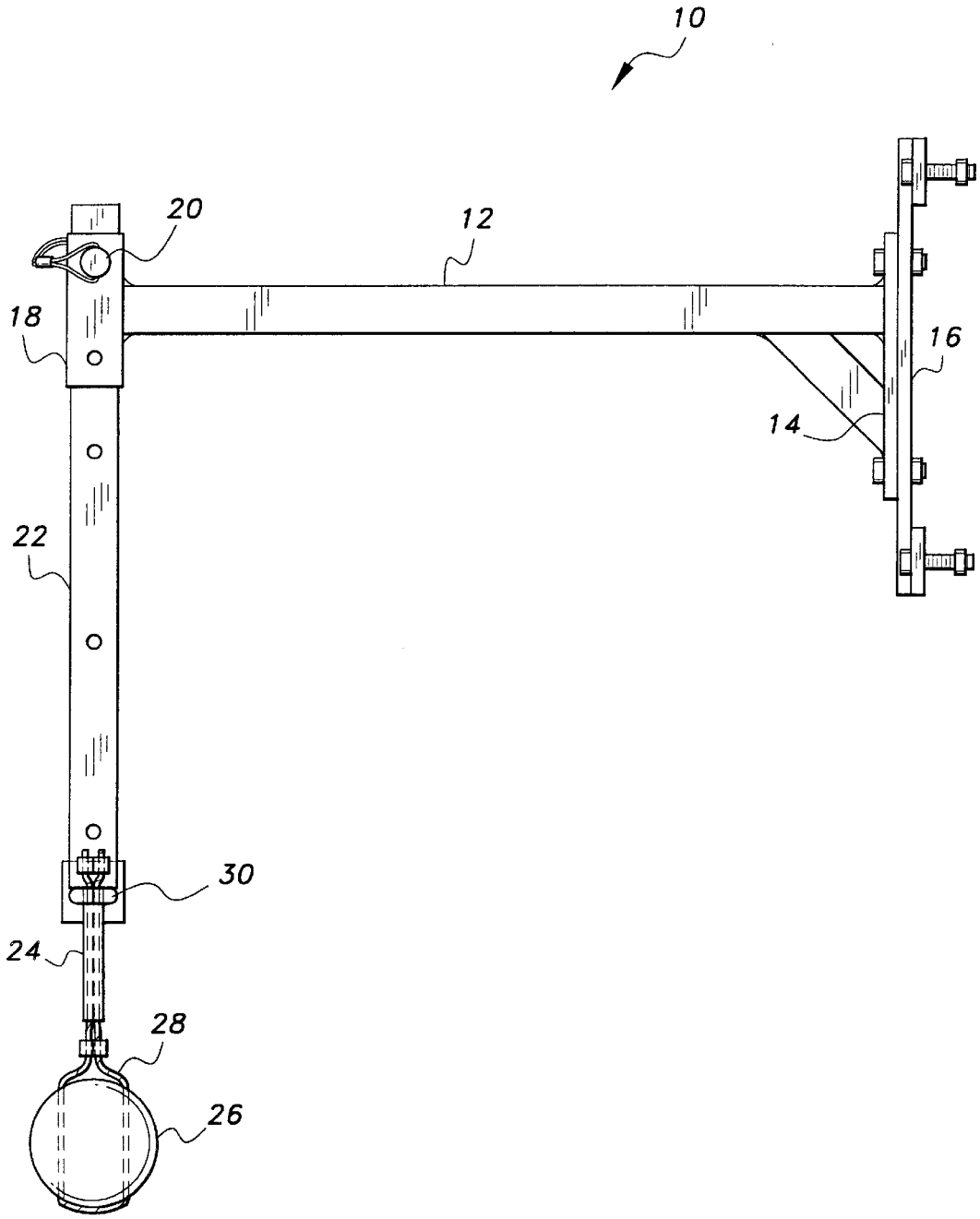
FIG. 1 is a side elevational view of a batting aid according to the present invention.
Figure 2:
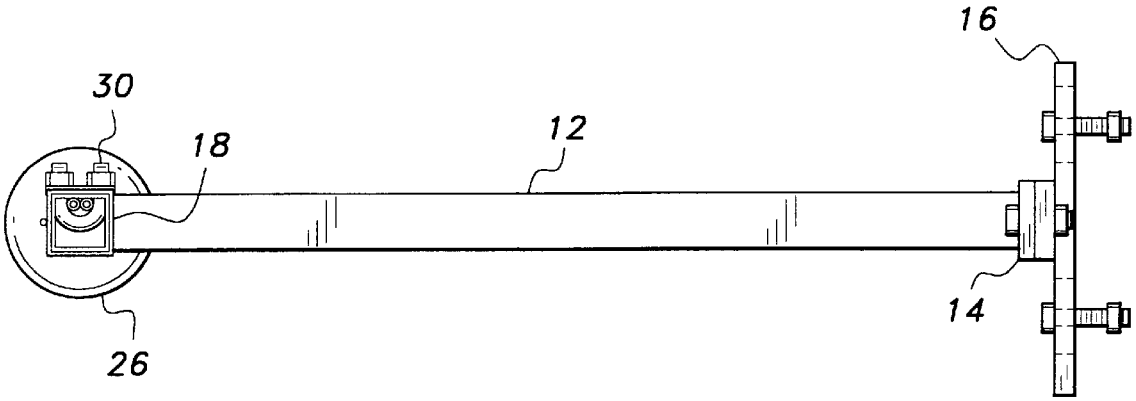
FIG. 2 is a top plan view of the invention.
Figure 3:
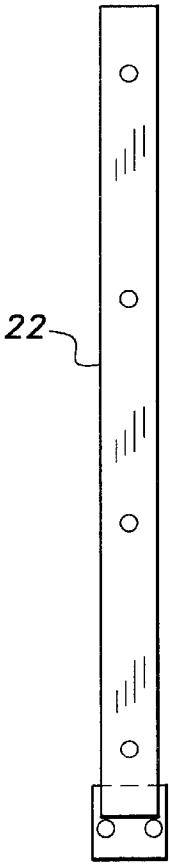
FIG. 3 is a front elevational view of the adjustable slide tube.
Figure 4:
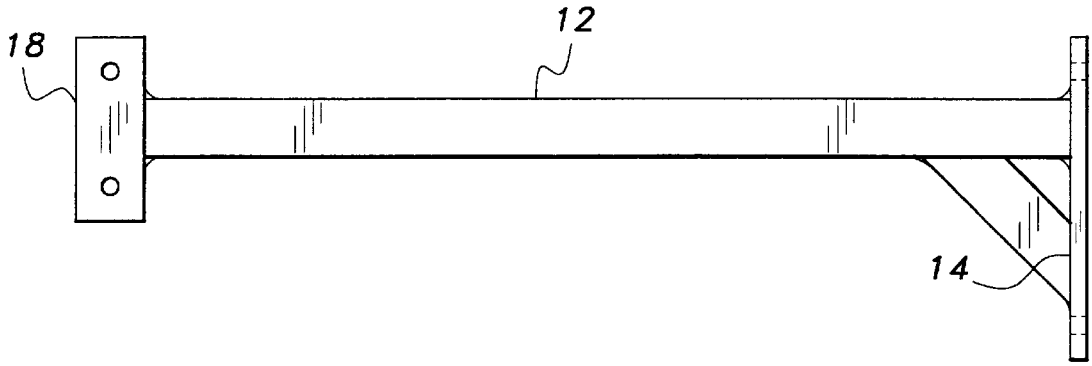
FIG. 4 is a side elevational view of the main frame.

On the other end, there is a slide tube pocket 18 with at least one through aperture to accept a pin or bolt 20 to hold the adjustable slide tube 22 at a chosen height. Both the slide tube pocket 18 and the adjustable slide tube 22 are of square cross section, as seen in FIG. 2, but any cross section may be used (e.g., circular, hexagonal, octagonal, etc.) that provides for quick and easy adjustment and provide a specific orientation of the ball 26.

A ball 26 is attached to the adjustable slide tube 22 by having a pair of holes drilled through the ball and wire cable 28, which may be coated, passed through. The cable 28 may have a keeper to maintain both portions of the cable in a side-by-side configuration. Adjacent the ends of the cable, a standard U-bolt 30 attaches the cable to the adjustable slide tube 22 and, with the nuts drawn tight, firmly engages the cable to give the ball some ability to absorb impacts from bats.

By having the cable eight to ten inches between ball 26 and U-bolt 30, a user may impact the ball quite harshly and not cause separation or injury to the assembly. By the cable being relatively short, there is little chance that a user could cause the ball to flail around and cause injury to the user or another nearby player.

This assembly also has mounting plate 16. The main frame 12 is attached by bolts to mount 16 but mount 16 can be attached to a wide variety of structures. By using U-bolts, mount 16 can be attached to most post-like structures such as fence members or telephone poles. It may be attached to most trees with little damage to the tree but the stand-off the main frame 12 provides the adjustable slide tube 22, enables users to make use of sections of the field not conducive to play of the game.

Main frame 12 is welded to standard mount 14, slide tube pocket 18 and the diagonal brace (not numbered) but any form of construction concurrent with the needs to absorb impact from bats and batters is appropriate.

U-bolt 30 attaches to the welded plate at the bottom of the adjustable slide tube 22 but any other mechanism is appropriate such as two bolts attaching a plate (not shown), to hold cable 28 in registration.

Bolt 20 may be held by a shock cord or wire to the slide tube pocket to prevent inadvertent loss, or bolt 20 may be a pin that is fixed in place by another "cotter key" (not shown), a pin with a spring loaded ball, not shown, or any other structure that may be easily adjusted to allow a batter to aim at a ball at specific heights and adjust his or her swing.

It is to be understood that the present invention is not limited to the embodiments described above, but encompasses any and all embodiments within the scope of the following claims.

We claim:

1. A batting aid for instruction of batters or warm-up of competitors comprising:

a main frame comprising a horizontal arm, and having a mounting end and a ball holding end;

a mounting assembly for securing said main frame to a supporting structure;

an adjustable slide tube assembly mounted on said main frame ball holding end, and having a lower end;

a cable attached to said tube assembly lower end; and a ball anchored to said cable; whereby said main frame provides a stand-off distance from said ball to said mounting assembly, and said ball is adjusted in height from the ground by said adjustable slide tube assembly.

2. The batting aid of claim 1 wherein said adjustable slide tube assembly comprises an outer tube pocket affixed to said main frame ball holding end, and an inner slide tube, there further being a plurality of matching pairs of apertures through said tube pocket and said inner tube, and a pin for insertion through selected apertures to vertically adjustably position said inner tube within said outer tube pocket.

3. The batting aid of claim 2, further comprising at least one U-bolt for anchoring said cable to said inner tube.

4. The batting aid of claim 1, further comprising means defining holes through said ball, through which said cable passes to firmly anchor said ball to said cable.

5. A batting aid for instruction of batters or warm-up of competitors comprising:

a main frame comprising a horizontal arm, and having a mounting end and a ball holding end;

a mounting assembly for securing said main frame to a supporting structure;

an adjustable slide tube assembly mounted on said main frame ball holding end, and having a lower end, said adjustable slide tube assembly comprising an outer tube pocket affixed to said main frame ball holding end, and an inner slide tube, there further being a plurality of matching pairs of apertures through said tube pocket and said inner tube, and a pin for insertion through selected apertures to vertically adjustably position said inner tube within said outer tube pocket;

a cable attached to said tube assembly lower end; and a ball anchored to said cable; whereby said main frame provides a stand-off distance from said ball to said mounting assembly, and said ball is adjusted in height from the ground by said adjustable slide tube assembly.

6. The batting aid of claim 5, further comprising at least one U-bolt for anchoring said cable to said inner tube.

7. The batting aid of claim 5, further comprising means defining holes through said ball, through which said cable passes to firmly anchor said ball to said cable.

* * * * *